US006829842B2

(12) United States Patent
Zuccaro

(10) Patent No.: US 6,829,842 B2
(45) Date of Patent: Dec. 14, 2004

(54) BALLET/POINTE SHOE AERATOR-CARRIER-PROTECTOR

(76) Inventor: Dennis J. Zuccaro, 7600 Kingsbridge, Canton, MI (US) 48187

( * ) Notice: Subject to any disclaimer, the term of this patent is extended or adjusted under 35 U.S.C. 154(b) by 0 days.

(21) Appl. No.: 10/342,356

(22) Filed: Jan. 15, 2003

(65) Prior Publication Data

US 2003/0131492 A1 Jul. 17, 2003

(51) Int. Cl.[7] ..... F25B 19/00

(52) U.S. Cl. ..... 34/235; 34/218; 34/104; 34/90

(58) Field of Search ..... 34/202, 90, 103, 34/104, 218, 232, 235, 227

(56) References Cited

U.S. PATENT DOCUMENTS

| | | | | | |
|---|---|---|---|---|---|
| 1,589,642 | A | * | 6/1926 | Harris | 34/621 |
| 2,350,191 | A | * | 5/1944 | Raymond | 68/189 |
| 3,258,850 | A | | 7/1966 | Swanson | |
| 3,905,125 | A | * | 9/1975 | Hubner | 34/622 |
| 3,974,666 | A | | 8/1976 | Coquery et al. | |
| 4,570,358 | A | * | 2/1986 | Sacerdote | 34/569 |
| 5,709,328 | A | | 1/1998 | Ackeret | |
| 5,729,908 | A | | 3/1998 | Braden | |
| 5,852,879 | A | * | 12/1998 | Schumaier | 34/802 |
| 6,457,257 | B1 | | 10/2002 | Hughes | |

FOREIGN PATENT DOCUMENTS

| | | | |
|---|---|---|---|
| JP | 406313677 | A | 11/1994 |

* cited by examiner

*Primary Examiner*—Ira S. Lazarus
*Assistant Examiner*—Kathryn S. O'Malley
(74) *Attorney, Agent, or Firm*—VanOphem & VanOphem, P.C.

(57) ABSTRACT

A preferred embodiment of the invention includes a vessel having a first end an a second end. A first cap is releasably mounted on the first end. A second cap is releasably mounted on the second end. The vessel is configured to prevent crushing and promote ventilating thereof. The first cap and/or second cap may have an aperture for ventilating the vessel. A fan is fixed relative to, for ventilating, the vessel. The fan is mounted on an end cap. The fan energizable with a battery. A switch is provided for selectably supplying energy to the fan. If a fan is provided, a barrier is disposed in the vessel configured to protect an object in the vessel from the fan. The barrier should have an aperture for ventilating the vessel. The invention may include a handle connected thereto, for carrying, the vessel.

7 Claims, 5 Drawing Sheets

BALLET/POINTE SHOE AERATOR-CARRIER-PROTECTOR

CROSS REFERENCE TO RELATED APPLICATION

This Application incorporates and claims the benefit of U.S. Provisional Application Ser. No. 60/347,867, filed Jan. 15, 2002, by Dennis J. Zuccaro, entitled Ballet/Pointe Shoe Aerator-Carrier-Protector.

BACKGROUND OF THE INVENTION

The invention was conceived when a dancer left her ballet pointe shoes in her dance bag on the floor of her changing room at a dance studio. Accidentally, another dancer tripped and stepped on the dance bag and the shoe therein, and destroyed the very delicate "box" located at the end of the shoe that supports the toes. Because ballet pointe shoes are expensive and must be broken in over a period of months, a need exists for protecting ballet pointe shoes.

After rigorous dancing, these pointe shoes can become quite damp with perspiration, which can lead to premature breakdown if not properly aired out. This also can cause the pointe shoes to develop an odor from the perspiration, especially when kept inside of a dance bag. A need exists for providing airflow over the shoes to keep them fresh and dry.

SUMMARY OF THE INVENTION

The invention is a ballet/pointe shoe aerator-carrier-protector for: (1) carrying ballet shoes; (2) protecting the "box" component of the shoes, which supports the toes, from being crushed and destroyed; and (3) "airing out" the contained shoes to help eliminate unpleasant odors and the premature breakdown of the ballet shoe materials due to moisture from perspiration.

To these ends, a preferred embodiment of the invention includes a vessel having a first end and a second end. A first cap is releasably mounted on the first end. A second cap is releasably mounted on the second end. The vessel is configured to prevent crushing and promote ventilating thereof. The first cap and/or second cap may have an aperture for ventilating the vessel. A fan may be fixed relative to, for ventilating, the vessel. The fan may be mounted on a cap. The fan may be energizable with a battery. A switch may provide for selectably supplying energy to the fan. If a fan is provided, a barrier may be disposed in the vessel configured to protect an object in the vessel from the fan. The barrier may have an aperture for ventilating the vessel. The invention may include a handle connected to, for carrying, the vessel.

Another embodiment of the invention includes a vessel configured to receive an object, means for retaining an object in the vessel and means for ventilating an object in the vessel. The vessel is configured to prevent crushing of an object therein. The vessel may have a cap on an end thereof and/or second cap on the other end thereof. One or both caps may have an aperture for ventilating the vessel. A fan may be fixed relative to, for ventilating, the vessel. The fan may be mounted on one of the caps. The fan may be energizable with a battery. A switch may provide for selectably supplying energy to the fan. If a fan is provided, a barrier may be disposed in the vessel configured to protect an object in the vessel from the fan. The barrier may have an aperture for ventilating the vessel. The invention may include a handle connected to, for carrying, the vessel.

The invention provides improved elements and arrangements thereof, for the purposes described, which are inexpensive, dependable and effective in accomplishing intended purposes of the invention. Other features and advantages of the present invention will become apparent from the following description of the preferred embodiment, which refers to the accompanying drawings.

BRIEF DESCRIPTION OF THE DRAWINGS

The invention is described in detail below with reference to the following figures, throughout which similar reference characters denote corresponding features consistently, wherein.

DETAILED DESCRIPTION OF THE PREFERRED EMBODIMENT

Figures 1, 2:
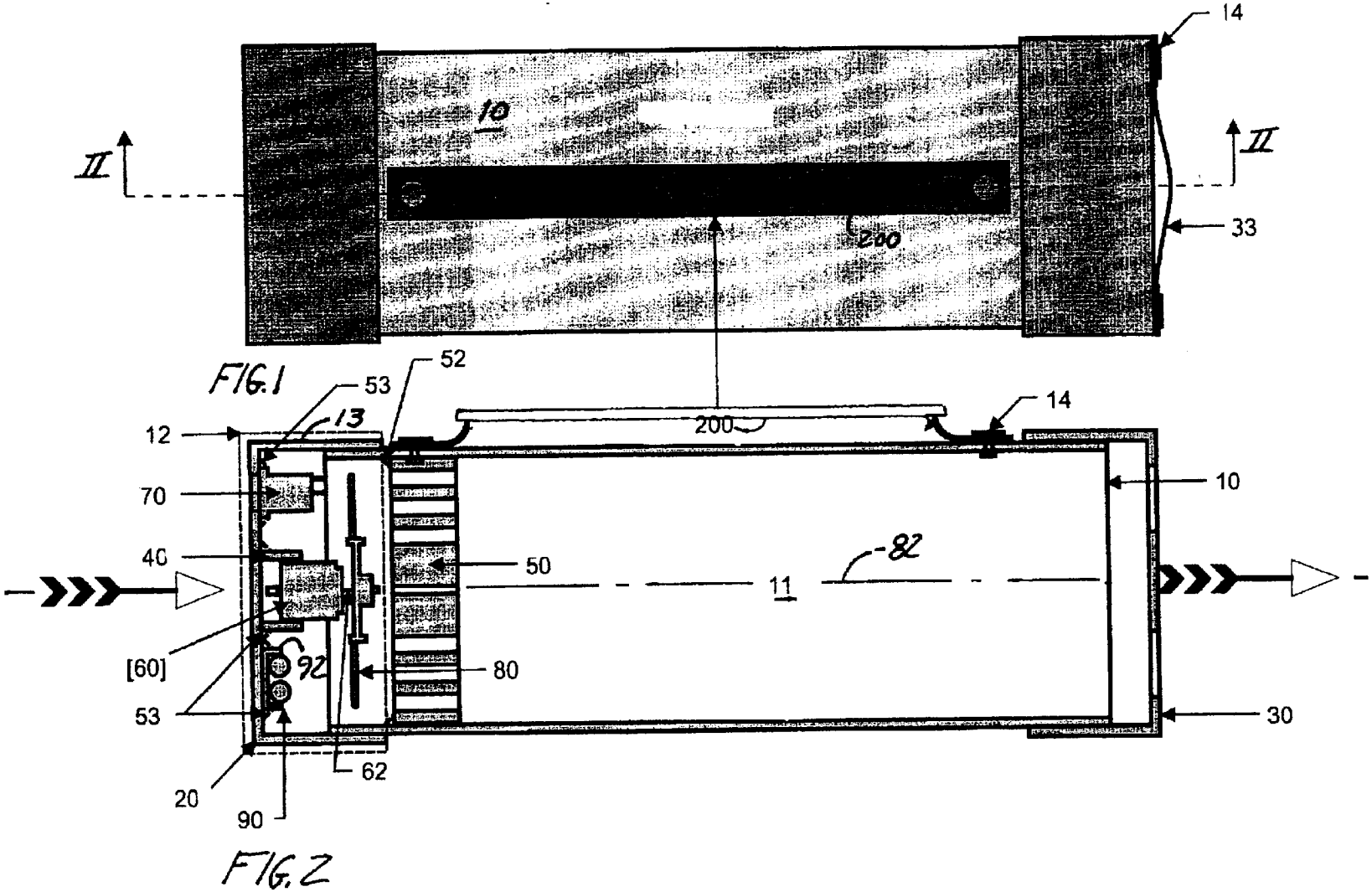
FIG. 1 is a plan view of an embodiment of a ballet/pointe shoe aerator-carrier-protector constructed according to principles of the invention.
FIG. 2 is a cross-sectional detail view drawn along line II—II in FIG. 1.

Referring to FIG. 1, a preferred embodiment of the invention includes a cylindrical vessel or tube 10 with a motor-fan/battery holder/switch housing end cap assembly 12 on one end, a shoe compartment end cap 30 on the other end, and an internal ballet/pointe shoe compartment 11, as shown in FIG. 2. Preferably, ballet/pointe shoe compartment 11 is configured to contain ballet/pointe shoes.

A basic construction of the invention may be obtained from standard 4.0-inch waste-drain-sewer poly-vinyl-chloride (WDS PVC) pipe, cut to proper length to define tube 10, and two standard 4.0-inch WDS PVC end caps to define an air inlet/switch housing end cap 20 of motor-fan/battery holder/switch housing end cap assembly 12, and shoe compartment end cap 30. Additional components may be fabricated and fitted to the pipe and end caps. Some basic machining processes may be applied to the end caps to complete the design. The components then are assembled.

Figure 3:
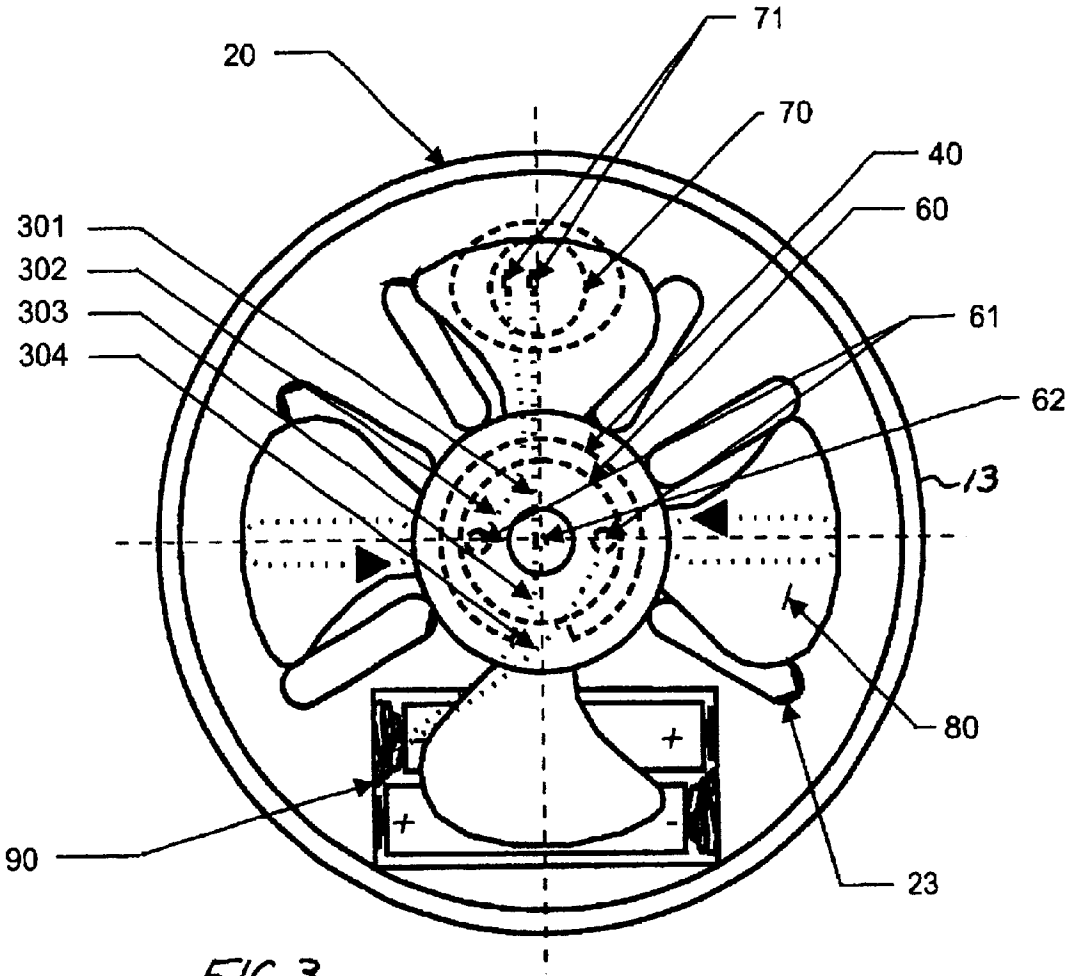
FIG. 3 is a side elevational view of an air/inlet/battery-holder/switch housing end cap of, from within, the embodiment of FIG. 1.

Referring to FIGS. 2 and 3, motor-fan/battery holder/switch housing end cap assembly 12 includes an air inlet/switch housing end cap 20 that houses a battery holder 92, for two AAA batteries 90, a single pole single throw (SPST) rocker switch 70 and a four-bladed plastic fan 80 mounted on a shaft 62 of a dc motor 60, preferably rated from 1.0 to 3.0 volts and 8300 rpm. The air inlet/switch housing end cap 20 is secured with a slip-tight fit over the tube 10, yet permits ready access to replace the batteries 90 or effect repairs.

Preferably, the battery-holder 92 is adhered to the bottom of the air inlet/switch housing end cap 20 with a bead of high temperature hot glue 53. This is done only after the circuit wires 301, 302, 303, and 304 shown in FIG. 3 are appropriately attached among the SPST rocker switch 70, the motor 60 and the battery-holder 92.

The rotation of the motor 60 is determined by the polarity of the electrical connection to the batteries 90. Accordingly, connections for the circuit wires 301, 302, 303, and 304 shown in FIG. 3 are made so that the fan 80 will draw air in through the air inlet/switch housing end cap 20 and exhaust the air from the internal ballet/pointe shoe compartment 11 through the shoe compartment end cap 30.

Figure 4:
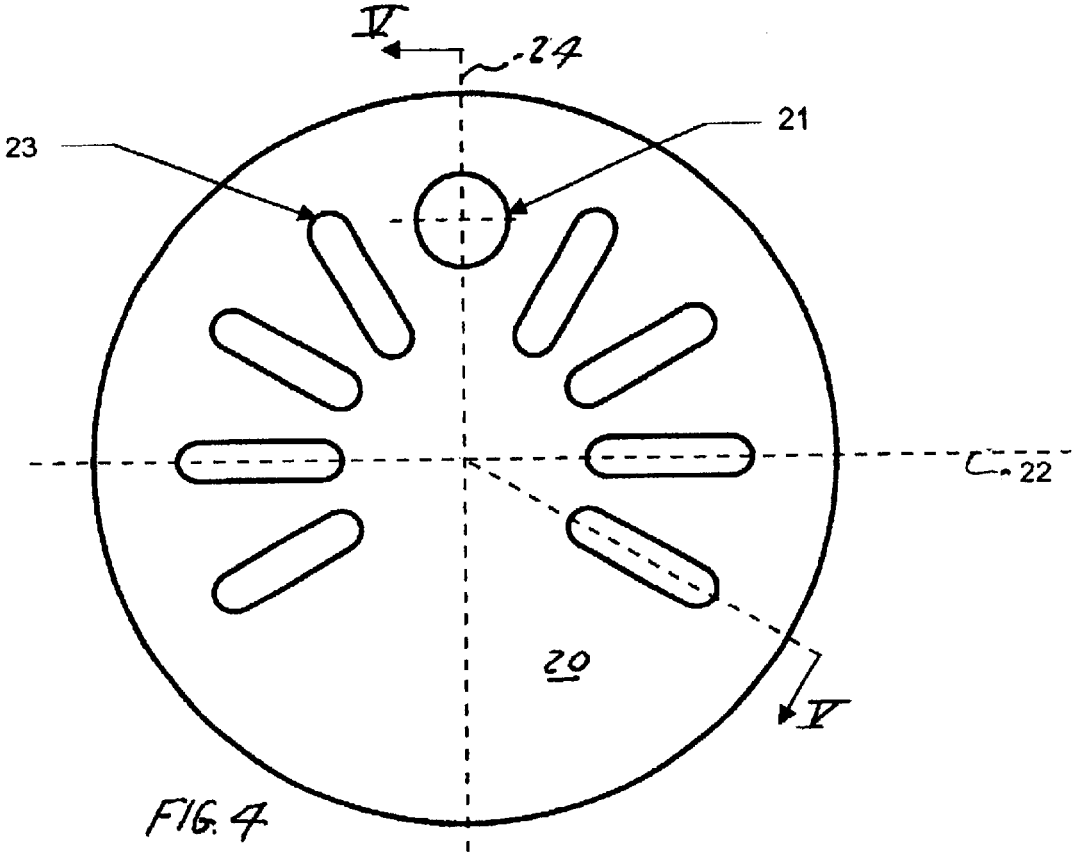
FIG. 4 is a side elevational view of the air/inlet/battery-holder/switch housing end cap of, from without, the embodiment of FIG. 1.
Figure 5:
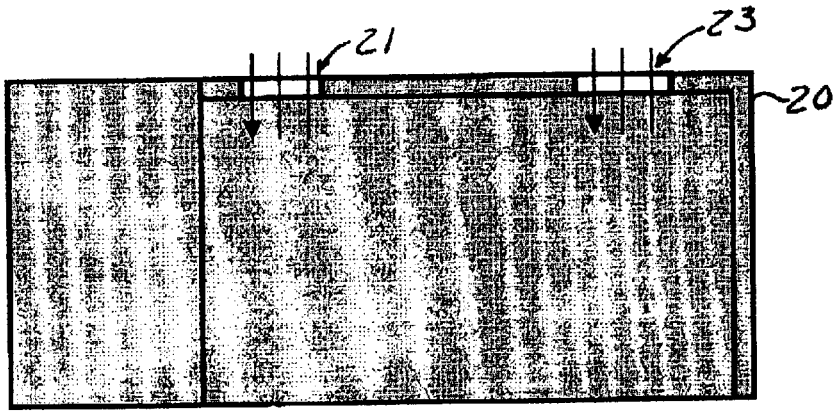
FIG. 5 is a cross-sectional detail view drawn along line V—V in FIG. 4.

Referring to FIGS. 2, 4 and 5, the air inlet/switch housing end cap 20 has a hole 21, preferably having a 0.5625-inch diameter, to accommodate the SPST rocker switch 70. The hole 21 is located on a vertical centerline axis 24, preferably 1.5 inches above a horizontal centerline axis 22. During installation, the SPST rocker switch 70 is centered into the access hole 21 and adhered to the bottom of air inlet/switch housing end cap 20 with a high temperature hot glue. When seated, the SPST rocker switch 70 is recessed below the surface of the air inlet/switch housing end cap 20 to prevent inadvertent energizing of the fan 80 and discharge of the batteries 90. The SPST rocker switch 70 is wired between the battery holder 92 and motor 60.

As shown in FIG. 4, circumnavigating the air inlet/switch housing end cap 20 counter-clockwisely from the right hand side of the centerline axis 22, preferably includes eight radial air inlet slots 23, preferably 0.25 inches wide and 1.0 inches long, machined at 0, 30, 60, 120, 150, 180, 210, and 330 degrees. Air drawn into the tube 10 through the air inlet slots 23 of the air inlet/switch housing end cap 20 via the fan 80 passes through and over the shoes (not shown) in the internal ballet/pointe shoe compartment 11, and then exits the internal ballet/pointe shoe compartment 11 via the air outlet slots 32 of the shoe compartment end cap 30, as shown in FIG. 6 and described in greater detail below.

Referring to FIG. 2, a motor sleeve/retainer 40 houses or mounts the motor 60 in the motor-fan/battery-holder/switch housing end cap assembly 12. Preferably, the motor sleeve/retainer 40 is formed from a 0.75-inch inner diameter PVC pipe having a 0.125-inch wall thickness cut to a 0.625-inch length. Motor sleeve/retainer 40 is split lengthwise and pried open to accept motor 60. Once the motor 60 is inserted into the motor sleeve/retainer 40, the split (not shown) increases in size and provides access to the solder terminals 61 of the motor 60, as shown in FIG. 3. Access also is created for the wire leads 302, 304 from the battery holder 92. The motor sleeve/retainer 40 is adhered to the bottom of the air inlet/switch housing end cap 20 with appropriate adhesive and high temperature hot glue.

Figure 6:
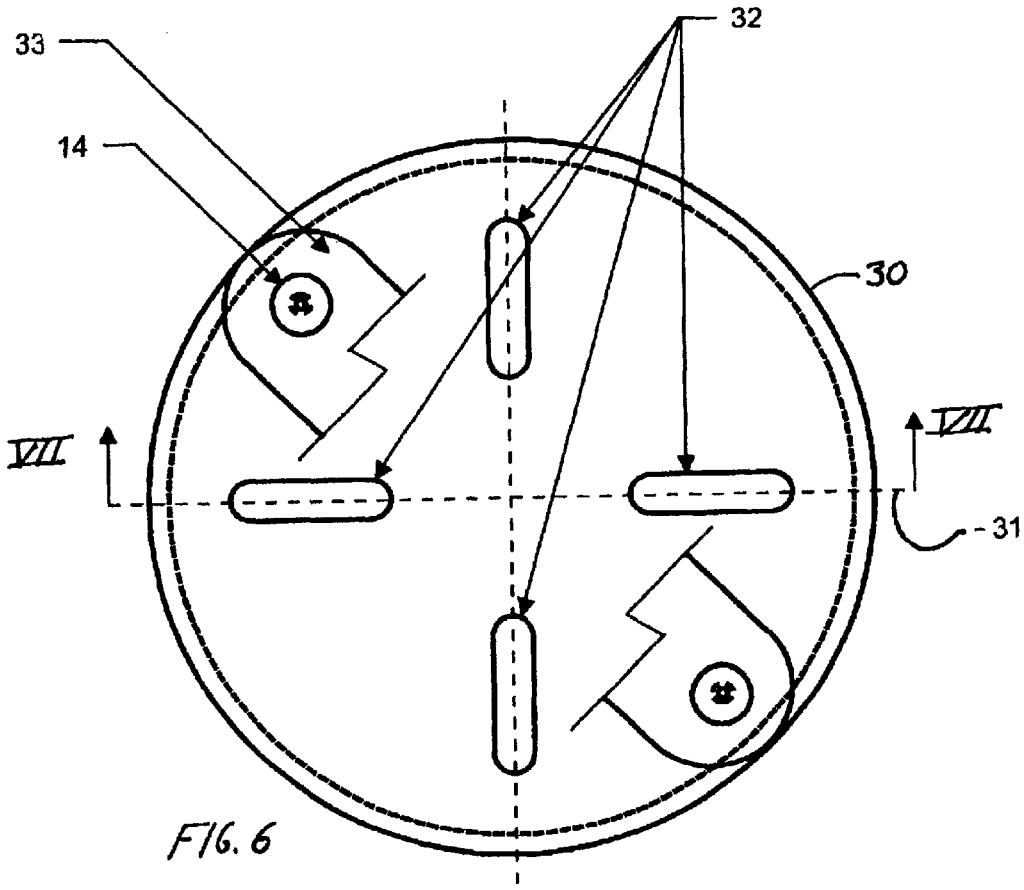
FIG. 6 is a side elevational view of a shoe compartment end cap of, from without, the embodiment of FIG. 1.
Figure 7:
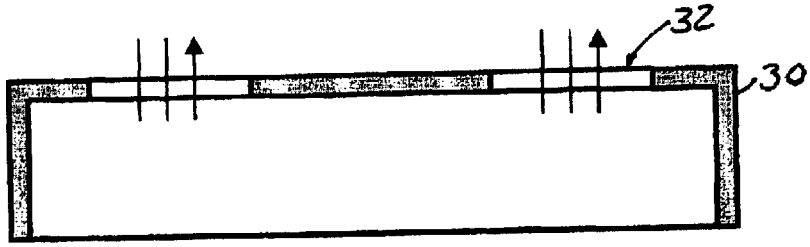
FIG. 7 is a cross-sectional detail view drawn along line VII—VII in FIG. 6.

Referring to FIGS. 6 and 7, the shoe compartment end cap 30 is secured with a slip fit over the tube 10, yet provides for ready access to the shoes stored in the internal ballet/pointe shoe compartment 11. A handle 33, connected to the shoe compartment end cap 30 with rivets 14, provides for assembly and disassembly of the shoe compartment end cap 30 and the tube 10.

The shoe compartment end cap 30 also is configured to allow airflow to exit the tube 10. As shown in FIG. 6, circumnavigating the shoe compartment end cap 30 counter-clockwisely from reference line 31, four radial air outlet slots 32, preferably 0.25 inches wide and 1.0 inches long, are machined at 0, 90, 180, and 270 degrees.

Figure 8:
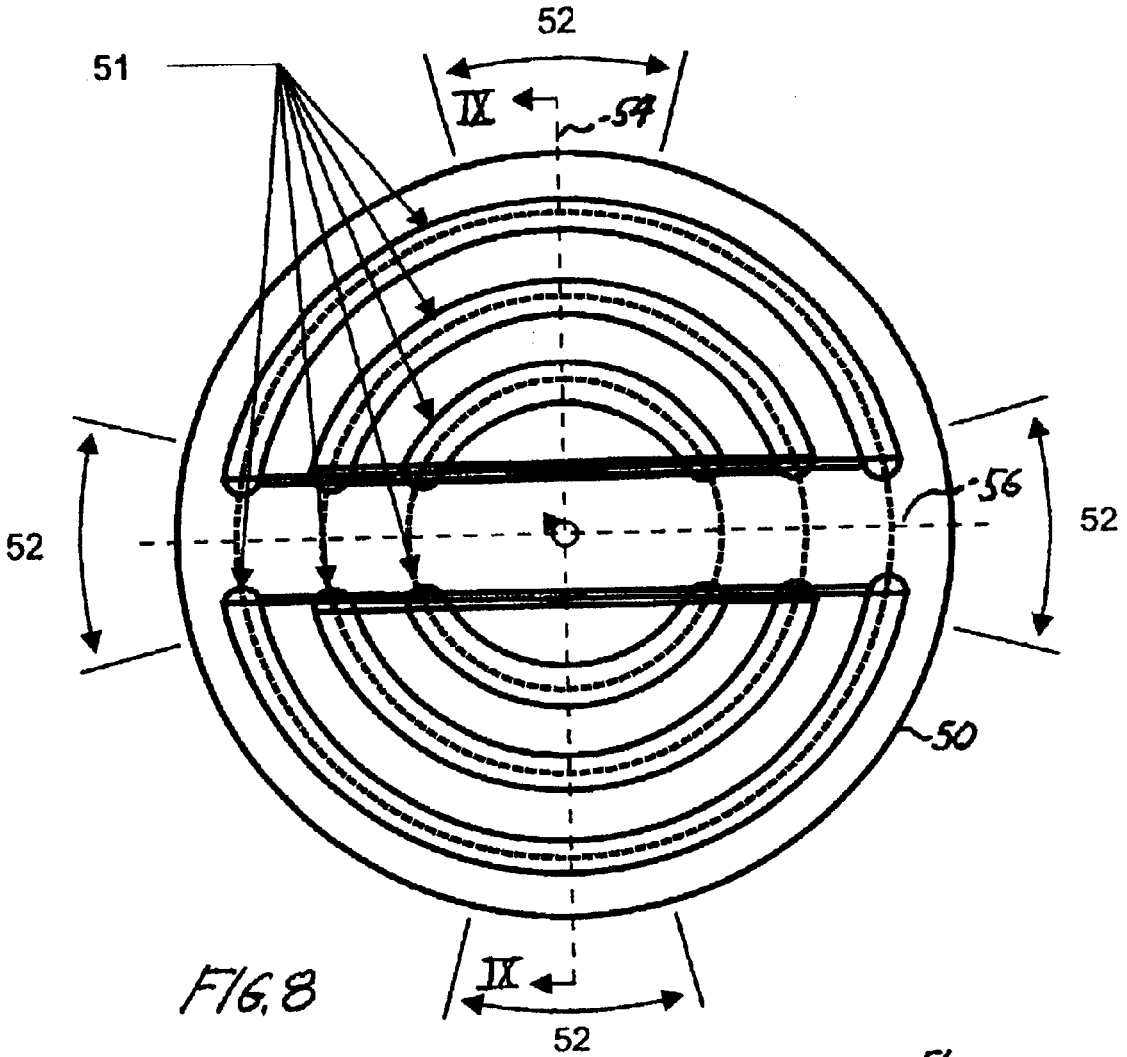
FIG. 8 is a side elevational view of a shoe barrier/air inlet of the embodiment of FIG. 1.
Figure 9:
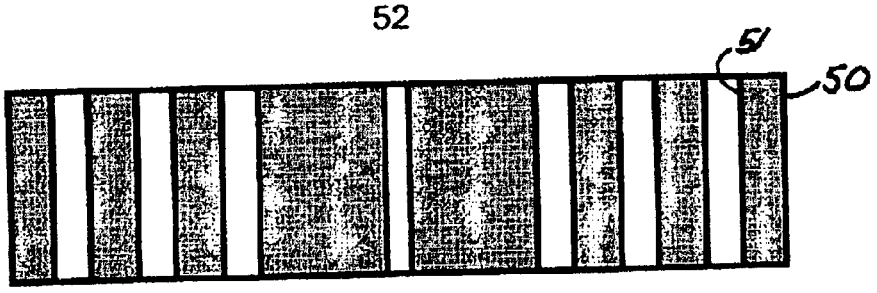
FIG. 9 is a cross-sectional detail view drawn along line IX—IX in FIG. 8.

Referring to FIGS. 8 and 9, a shoe barrier/air inlet sleeve 50 isolates the shoes from the fan 80 and forms one end of the internal ballet/pointe shoe compartment 11. The shoe barrier/air inlet sleeve 50, which may be constructed of styrofoam, is inserted into tube 10 preferably one inch from the end adjacent to the air inlet/switch housing end cap 20. Preferably, the shoe barrier/air inlet sleeve 50 is machined to provide six 0.1875-inch circumferential slots allowing axial airflow therethrough, developed by the fan 80, to enter the internal ballet/pointe shoe compartment 11. The shoe barrier/air inlet sleeve 50 is adhered to the tube 10 with beads (not shown) of low temperature hot glue at four alignments 52 located 30 degrees from the perpendicular centerlines 54 and 56.

Referring to FIG. 2, the internal ballet/pointe shoe compartment 11 is defined by the tube 10, the shoe compartment end cap 30 and shoe barrier/air inlet sleeve 50. Ballet shoes may be contained within the internal ballet/pointe shoe compartment 11. The air inlet/switch housing end cap[s] 20, shoe compartment end cap 30 and the shoe barrier/air inlet sleeve 50 are appropriately slotted so that the fan 80 can create an airflow along the axis 82 of the tube 10. The fan 80 flows air along the axis of the tube 10 by drawing air in through the motor-fan/battery-holder/switch housing end cap assembly 12 and exhausting the air out of the shoe compartment end cap 30. The axial airflow "airs out" the contained shoes.

A 2-foot long carrying strap 200 is installed on the tube 10, generally aligned with the axis 82 and between the inboard edges 13 of the end caps 20, 30 via two 0.125-inch pop rivets 14. The carrying strap 200 makes the ballet/pointe shoe aerator-carrier-protector more convenient to carry.

With the invention described above, a dancer may carry ballet shoes, whether pointe shoes or standard ballet slippers, and protect the delicate "box" of the shoes from being damaged or crushed. Once the dancer has finished dancing, the container can be used to "air out" the shoes with the circulation fan. This will provide the dancer the ability to keep their shoes fresh and dry.

The invention is not limited to the particular embodiments described herein, rather only to the appended claims

I claim:

1. A portable storage container adapted to carry dancing shoes, said portable storage container comprising:

a cylindrical tubular open-ended vessel having a permeable partition sleeve mounted between said open ends to define one end portion and an opposite end portion;

a first permeable cylindrical cover member removably mounted to said one end portion of said tubular vessel, said first permeable cover member and said permeable partition sleeve defining a storage compartment portion such that said dancing shoes may be stored therein;

a second permeable cylindrical cover member removably mounted to said opposite end portion of said open-ended cylindrical tubular vessel, said permeable cylindrical second cover member further comprising:

an internal end surface having an aperture therein;

an annular sleeve retainer member mounted to said internal end surface of said cover member;

means for radially adjusting said annular sleeve retainer member, said means for radially adjusting mounted to said internal end surface of said cover member;

a motor and fan assembly mounted to said annular sleeve retainer member such that when said second permeable cylindrical cover member is mounted to said opposite end portion of said cylindrical tubular vessel said fan of said motor and fan assembly is juxtaposed said permeable partition sleeve mounted between said open ends of said open-ended vessel;

a battery power source mounted to said internal end surface of said cover member adjacent said annular sleeve member; and means for actuating said motor and fan assembly, said actuating means mounted to said internal end surface and projecting through said aperture therein whereby upon actuation of said motor and fan assembly by said actuating means an ambient airflow is established by the movement of said fan drawing air through said second permeable cylindrical cover member and pushing said same volume of air through said permeable partition sleeve across said storage compartment portion and through said first permeable cylindrical cover member to exit from said storage container thereby drying said dancing shoes stored in said storage container.

2. The portable storage container as claimed in claim 1 wherein said permeable partition sleeve has a plurality of arcuate slots therein.

3. The portable storage container as claimed in claim 1 wherein said first permeable cylindrical cover member has a plurality of radially extending slots therein.

4. The portable storage container as claimed in claim 1 wherein said internal end surface of said second permeable cylindrical cover member has a plurality of radially extending slots therein.

5. The portable storage container as claimed in claim 1 wherein said means for actuating said motor and fan assembly comprises an on-off switch.

6. The portable storage container as claimed in claim 1 further comprising means for attaching said annular sleeve retainer member to said internal end surface of said second permeable cylindrical cover member.

7. The portable storage container as claimed in claim 1 further comprising a handle connected to said vessel for carrying said portable storage container.

* * * * *

UNITED STATES PATENT AND TRADEMARK OFFICE

CERTIFICATE OF CORRECTION

PATENT NO. : 6,829,842 B2
DATED : December 14, 2004
INVENTOR(S) : Dennis J. Zuccaro It is certified that error appears in the above-identified patent and that said Letters Patent is hereby corrected as shown below:

Column 2,
Line 49, before “tube 10”, kindly insert -- the --.
Line 51, before “shoe compartment”, kindly insert -- a --.
Line 53, before “end caps”, kindly insert -- the --.
Line 56, before “motor-fan/battery”, kindly insert -- the --.

Column 3,
Line 23, before “motor”, kindly insert -- the --.
Line 40, kindly delete “Motor”, kindly insert -- The motor --.

Signed and Sealed this

Twelfth Day of April, 2005

JON W. DUDAS
*Director of the United States Patent and Trademark Office*